US006231406B1

(12) United States Patent
Lin et al.

(10) Patent No.: US 6,231,406 B1
(45) Date of Patent: May 15, 2001

(54) CONTACT STRIP FOR ELECTRICAL CONNECTOR

(75) Inventors: Nick Lin, Hsin-Chuang; Hsin-Yu Yu, Tu-Chen, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/686,318

(22) Filed: Oct. 10, 2000

(30) Foreign Application Priority Data

Apr. 18, 2000 (TW) ..... 089206321

(51) Int. Cl.[7] ..... H01R 13/02
(52) U.S. Cl. ..... 439/885; 439/886
(58) Field of Search ..... 439/856, 884, 439/885, 886, 70, 71–83, 590, 594, 713, 717, 937

(56) References Cited

U.S. PATENT DOCUMENTS 3,864,008 * 2/1975 Bakermans et al. ..... 439/885 X
3,864,014 * 2/1975 Lynch ..... 439/885 X
5,616,044 * 4/1997 Tsai ..... 439/856 X
5,797,774 * 8/1998 Kaneko ..... 439/856 X

* cited by examiner

*Primary Examiner*—Brian Sircus
*Assistant Examiner*—Son V. Nguyen
(74) *Attorney, Agent, or Firm*—Wei Te Chung

(57) ABSTRACT

A contact strip includes a number of conductive contacts (4), a contact carrier (5) and a corresponding number of links (6) connecting corresponding contacts to the contact carrier. Each contact includes a contact portion (42) and a soldering portion (43) opposite the contact portion for attaching a solder ball for soldering to a printed circuit board. The contact portion is plated with gold using a molten gold plating liquid for enhancing electrical/mechanical characteristics of the contact portion. Each link defines a longitudinal slot (61) for obstructing a wicking path from the contact to the contact carrier. Furthermore, an elongate opening (52) is defined in the contact carrier above and perpendicular to a corresponding slot to further prevent the plating liquid from wicking up to the contact carrier, thereby preventing loss of the expensive plating liquid and reducing the cost of the contact.

11 Claims, 3 Drawing Sheets

CONTACT STRIP FOR ELECTRICAL CONNECTOR

BACKGROUND OF THE INVENTION

1. Field of the Invention

The present invention relates to a contact strip, and particularly to a contact strip for a Ball Grid Array (BGA) electrical connector, wherein the contact strip is provided with a means for saving plating liquid during plating of the conductive contacts thereof.

2. Description of the Prior Art

Referring to FIG. 4, a prior art contact strip for a BGA electrical connector (not shown) comprises a plurality of contacts 1, a contact carrier 2 and a corresponding number of links 3 connecting respective contacts 1 to the contact carrier 2 via a neck portion 31 of the link 3. When the contacts 1 are inserted into a housing (not shown) of the connector, the contact carrier 2 is bent away from the contacts 3 from the connection between the contacts 1 and corresponding necks 31. Each contact 1 comprises a soldering portion 12 for attaching a solder ball (not shown) thereto for soldering to a printed circuit board (not shown) and a contact portion 11 for engaging with a pin of a CPU (not shown). The contact portions 11 are plated with an expensive precious metal for increasing the current carrying capacity and reducing resistance of mated connections with pins of the CPU. However, the liquid precious metal may be wicked onto the links 3 and onto the contact carrier 2 during plating, thereby wasting precious metal plating, increasing the cost of the electrical connector.

Hence, an improved contact strip for a BGA electrical connector is required to overcome the disadvantages of the prior art.

BRIEF SUMMARY OF THE INVENTION

A main object of the present invention is to provide a contact strip for a BGA electrical connector, wherein the contact strip provides means for preventing loss of expensive plating metal during plating of the contacts.

A contact strip for a BGA connector of the present invention comprises a plurality of conductive contacts, a contact carrier and a corresponding number of links connecting respective contacts to the contact carrier via neck portions of the links. Each contact comprises a contact portion for electrically contacting a pin of a CPU and a soldering portion for attaching a solder ball prior to soldering to a printed circuit board. The contact portion is plated with a liquified gold plating for enhancing its electrical/mechanical characteristics. Each link defines a longitudinal slot designed to obstruct a wicking path of the plating liquid, thereby preventing loss of the plating liquid by wicking onto the contact carrier. Furthermore, a plurality of elongate openings are defined in the contact carrier above and perpendicular to the slots for further preventing the plating liquid from wicking onto the contact carrier, thereby preventing waste of the liquified gold.

Other objects, advantages and novel features of the invention will become more apparent from the following detailed description of the present embodiment when taken in conjunction with the accompanying drawings.

DETAILED DESCRIPTION OF THE INVENTION

Figure 1:
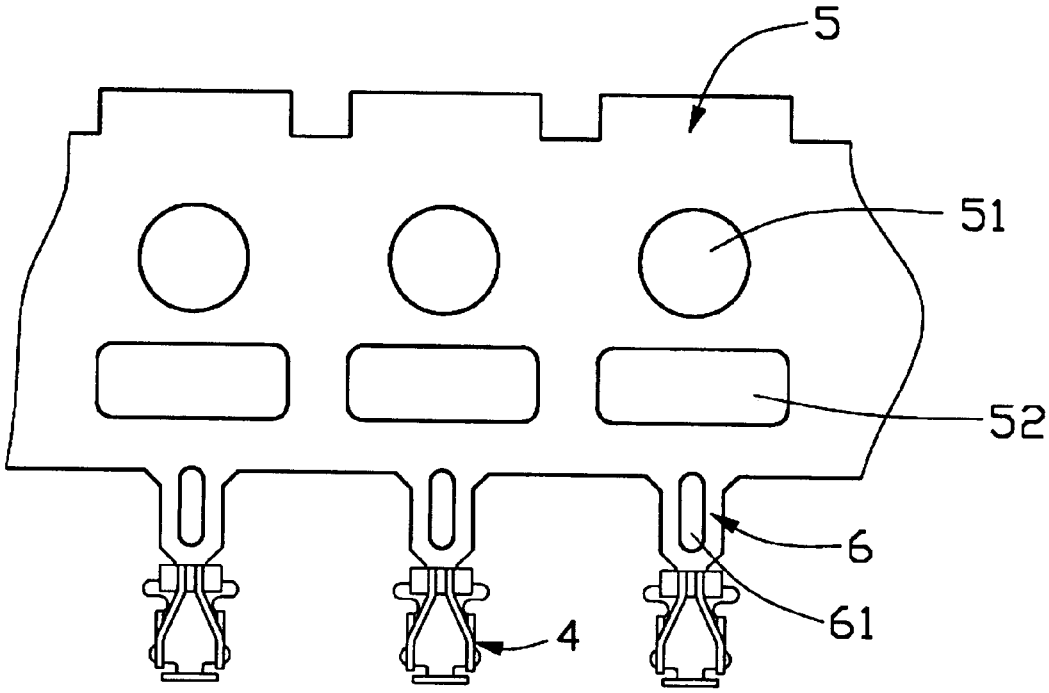
FIG. 1 is a front planar view of a contact strip for a BGA electrical connector in accordance with the present invention.
Figure 2:
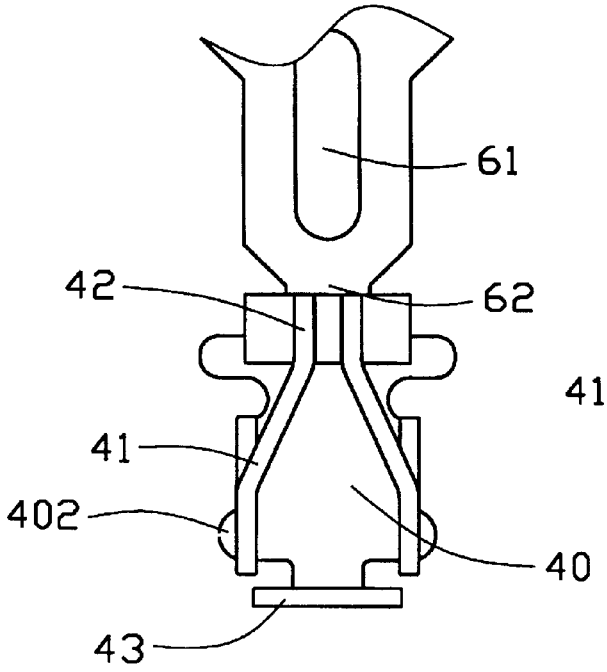
FIG. 2 is an enlarged front planar view of a conductive contact of FIG. 1.

Referring to FIGS. 1 and 2, a contact strip of a BGA electrical connector (not shown) in accordance with the present invention comprises a contact carrier 5, a plurality of conductive contacts 4 and a corresponding number of links 6 connecting corresponding contacts 4 to the contact carrier 5 via necks 62 of the links 6. When the contacts 4 are inserted into a dielectric housing (not shown) of the connector, the contact carrier 5 is bent away from the contacts 4 at the connections between the contacts 4 and corresponding necks 62. A number of pilot holes 51 are defined in the contact carrier 5 for guiding a proper advancing movement of the contact carrier 5 through different pressing stations during stamping of the contacts 4.

Figure 3:
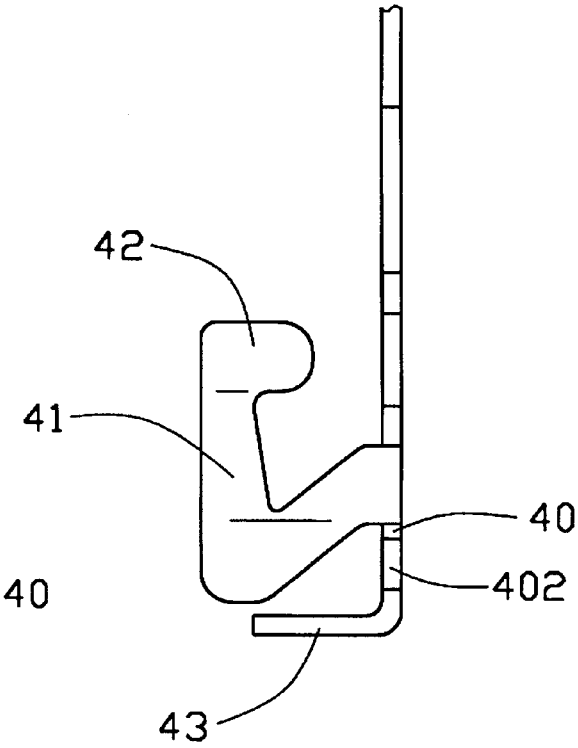
FIG. 3 is a side planar view of FIG. 2.
Figure 4:
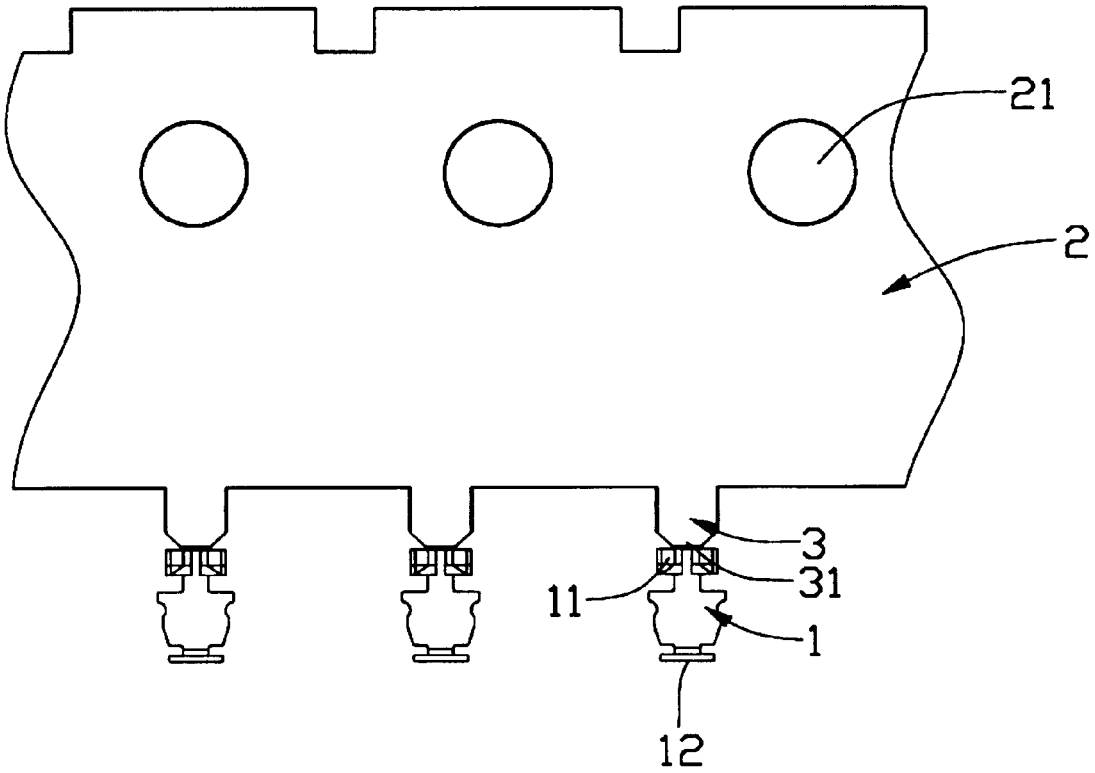
FIG. 4 (PRIOR ART)
FIG. 4 is a front planar view of a prior art contact strip for a BGA electrical connector.

Also referring to FIG. 3, each of the contacts 4 comprises a back plate 40 and a pair of retaining arms 41 extending downward and then upward from lateral sides of the back plate 40. The back plate 40 forms a pair of arced protrusions 402 on opposite sides thereof for retaining the contact 4 in the housing of the BGA connector. A pair of contact portions 42 are formed at upper ends of the retaining arms 41 for electrically mating with a pin of a CPU (not shown). The contact portions 42 are plated in gold using a molten gold plating liquid for enhancing the mechanical, chemical and electrical characteristics of the contact portions 42. Improved characteristics include reducing corrosion, surface friction and electrical resistance. A soldering portion 43 extends horizontally from a lower end of the back plate 40 opposite to the contact portions 42. The soldering portion 43 is adapted for attaching a solder ball thereto prior to soldering to a printed circuit board (not shown) using Surface Mounting Technology (SMT).

Each of the links 6 connects with an upper end of the back plate 40 via a corresponding neck 62 at a position adjacent the contact portion 42. Furthermore, each link 6 defines a slot 61 along its vertical axis to obstruct a wicking path formed along the link 6, thereby preventing the plating liquid from being wicked up to the contact carrier 5 via the link 6.

An elongate opening 52 is horizontally defined in the contact carrier 5 between each pilot hole 51 and a corresponding slot 61, and perpendicular to said corresponding slot 61. Thus, the wicking path is further obstructed by the openings 52, thereby further preventing the plating liquid from wicking up to the contact carrier 5. This arrangement prevents loss of the expensive plating metal, and accordingly lowers the manufacturing cost of the connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size,and arrangement of parts within the principles of the invention to the full extent indicated by the broad general meaning of the terms in which the appended claims are expressed.

What is claimed is:

1. A contact strip for an electrical connector, comprising:

a contact having a back plate, at least an arm extending from the back plate, and a soldering portion extending horizontally from a lower end of the back plate, wherein the arm further forms a contact portion and the contact portion is plated with a metal using a molten plating liquid for improving an electrical contact between the contact portion and a pin of a CPU, and wherein the soldering portion is for attaching a solder ball prior to soldering to a printed circuit board;

a contact carrier defining a pilot hole for guiding a proper advancing movement of the contact carrier during stamping of the contact;

a link connecting the contact carrier with an upper end of the back plate of the contact, the link defining a slot therethrough for preventing the plating liquid from being wicked up to the link;

wherein the contact carrier further defines an elongate opening between the pilot hole and the slot of the link for further preventing the plating liquid from wicking onto the contact carrier.

2. The contact strip as claimed in claim 1, wherein the opening of the contact strip extends perpendicular to the slot of the link.

3. The contact strip as claimed in claim 1, wherein said at least an arm comprises a pair of arms extending downward and then upward from opposite sides of the back plate.

4. The contact strip as claimed in claim 1, wherein the back plate forms a pair of arced protrusions on opposite sides thereof for retaining the contact in a dielectric housing of the electrical connector.

5. A contact strip for an electrical connector, comprising:

a contact having a back plate, at least an arm extending from the back plate and forming a contact portion, and a soldering portion extending from a lower end of the back plate, wherein the contact portion is plated with a metal using a molten plating liquid for improving an electrical contact between the contact portion and a pin of a CPU, and wherein the soldering portion is for attaching a solder ball prior to soldering to a printed circuit board;

a contact carrier defining a pilot hole for guiding a proper advancing movement of the contact carrier during stamping of the contact, and an elongate opening below the pilot hole for preventing the plating liquid from being wicked up to the contact carrier; and a link disposed between the contact and the contact carriers, wherein the link defines a slot therethrough extending perpendicular to the opening of the contact carrier, and wherein the opening of the contact carrier is located between the pilot hole and the slot of the link.

6. The contact strip as claimed in claim 5, wherein said at least an arm comprises a pair of arms extending downward and then upward from opposite sides of the back plate.

7. The contact strip as claimed in claim 5, wherein the back plate forms a pair of arced protrusions on opposite sides thereof for retaining the contact in a dielectric housing of the electrical connector.

8. A contact strip for an electrical connector, comprising:

a contact carrier;

a number of contacts being attached to a lower portion of the contact carrier;

at least a slot being defined in the contact carrier adjacent each of the contacts for preventing a wicking of a plating liquid from a contact to a portion of the contact carrier above the at least a slot during plating of the contacts, wherein the contact carrier comprises a number of links connecting the contact to the contact carrier and the contacts are attached to lower ends of the links, and the slots are defined in the links and extend along a vertical direction of the links, and at least an opening in the contact carrier located above a corresponding link and extending in a direction perpendicular to a corresponding slot.

9. The contact strip as claimed in claim 8, wherein each contact further comprises a back plate and a pair of arms extending downward and then upward from opposite sides of the back plate.

10. The contact strip as claimed in claim 9, wherein the back plate forms a pair of arced protrusions on opposite sides thereof for retaining the contact in a dielectric housing of the electrical connector.

11. The contact strip as claimed in claim 10, wherein each of the arms of the contact comprises a contact portion adapted for electrically engaging with a complementary electrical device, a metal being plated to the contact portion during a plating process of the contact.

* * * * *